US005896584A

United States Patent [19]

Hauser

[11] Patent Number: 5,896,584

[45] Date of Patent: Apr. 27, 1999

[54] SPORTS GLOVE

[76] Inventor: John P. Hauser, 1160 Bower Hill Rd., Apartment 1100B, Pittsburgh, Pa. 15243

[21] Appl. No.: 08/999,180

[22] Filed: Dec. 29, 1997

Related U.S. Application Data

[63] Continuation-in-part of application No. 08/323,634, Oct. 12, 1994, abandoned.

[51] Int. Cl.[6] ..... A41D 19/00

[52] U.S. Cl. ..... 2/161.1; 2/159

[58] Field of Search ..... 2/161.1, 161.2, 2/161.3, 158, 159, 267, 169, 20, 19, 16

[56] References Cited

U.S. PATENT DOCUMENTS

| | | | |
|---|---|---|---|
| 3,606,614 | 9/1971 | Dimitroff | 2/159 |
| 4,042,975 | 8/1977 | Elliott, Jr. et al. | 2/19 |
| 4,071,913 | 2/1978 | Rector | 2/161.1 X |
| 4,624,016 | 11/1986 | Luevano | 2/161.1 |
| 5,557,803 | 9/1996 | Granich et al. | 2/16 |
| 5,581,809 | 12/1996 | Mah | 2/20 |
| 5,697,104 | 12/1997 | Welton | 2/159 |

*Primary Examiner*—Gloria M. Hale
*Attorney, Agent, or Firm*—Dougherty & Associates

[57] ABSTRACT

A sports glove that improves a wearer's ability to grasp an object having a generally cylindrical handle while maximizing the amount of handling force the wearer's hand applies to the object. The sports glove includes any conventional glove having a palm portion and a resilient and compressible pad that is attachable to the palm portion of the glove. The compressible pad includes a generally planar glove attachment surface and a generally convex palm engaging surface opposite the glove attachment surface. The glove attachment surface of the pad is attached to the inner surface of the palm portion of the glove so that the palm engaging surface faces the palm of the hand. The pad has a generally tear drop shape that allows the pad to fit into the mid-palmer space of the hand within the palmer limit of the first web space of the hand, the palmer limit of the finger pads over the second, third, and fourth metacarpals of hand, the palmer limit of the hypothenar pad and the palmer limit of the thenar pad.

20 Claims, 3 Drawing Sheets

Fig.1
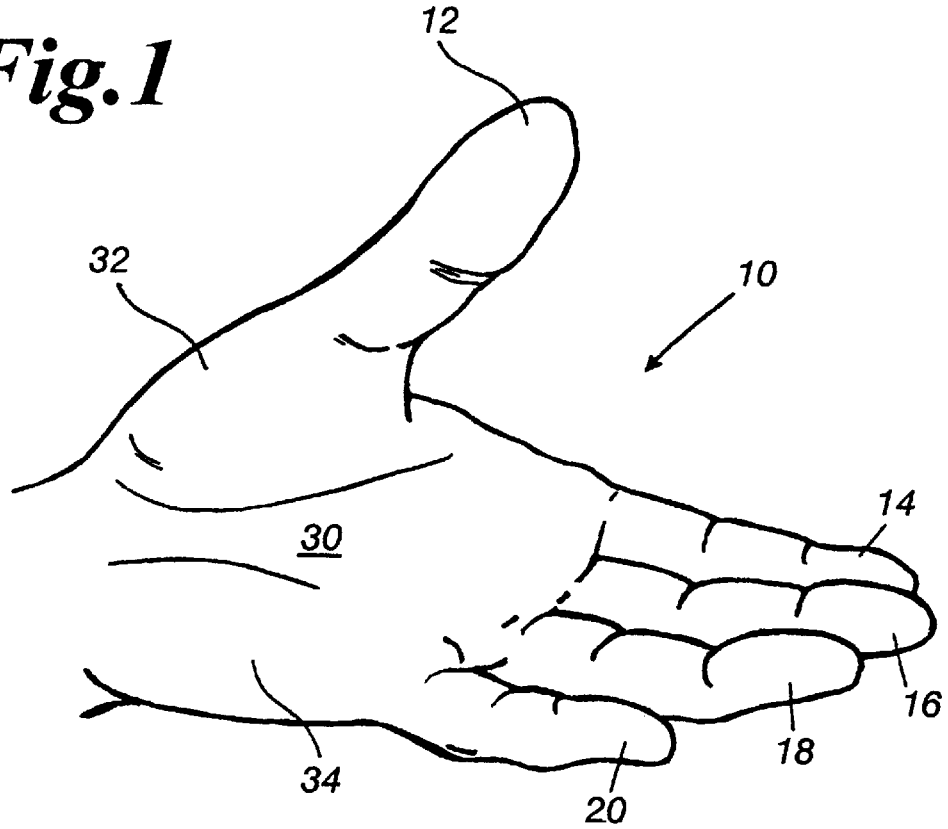
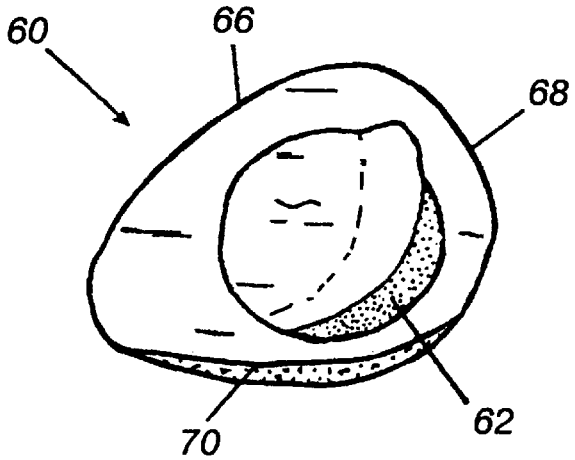
Fig.6

SPORTS GLOVE

This application is a continuation-in-part of U.S. patent application Ser. No. 08/323,634 filed Oct. 12, 1994.

FIELD OF THE INVENTION

The present invention relates to a glove, and more particularly to a glove for improving the ability of a wearer's hand to grip or grasp objects having a generally cylindrical shape.

BACKGROUND OF THE INVENTION

The human hand includes metacarpals that are associated with the fingers of the hand, and each metacarpal varies from the other metacarpals in length. This variance in the lengths of the metacarpals creates a void in a mid-palmer space of the hand when the hand is cupped or closed. Thus, the structure of a human hand is well suited for gripping a spherical shaped object, such as an orange or a baseball, because spherical shaped objects tend to fill the void. However, when a person attempts to grab an object having a generally cylindrical shaped handle, such as a baseball bat or a golf club, the third and fourth metacarpals, respectively associated with the middle and ring fingers, are in a position that minimizes the amount of direct pressure the third and fourth metacarpals may exert on the handle. Consequently, the third and fourth metacarpals minimally contribute to the force exerted by the hand on the object having a generally cylindrical shaped handle. The person's control over objects having a generally cylindrical shaped handle is limited to the amount of direct surface contact between the metacarpals of the hand and the handle.

Various types of gloves have been developed to provide a wearer with better handling of non-spherical shaped objects while also providing some protection to the wearer's hand. One example is a cycling glove having a thinly padded palm surface between the cyclist's palm and a handle grip of a bicycle. The cycling gloves provide the cyclist with a firm grasp of the handle grip for long periods of time when moisture tends to develop and accumulate on the cyclist's palm. Another example is a batter's glove having very thin padding, if any padding at all, along a palm surface and a tactile surface also along the palm surface for providing a batter with "tacky" hands. The batter's glove provides the batter with minimal hindrance to grasping and holding a bat while providing a protective barrier between the hand and the bat to minimize callous development. Additionally, the tactile surface of the batter's glove acts to increase the frictional force between the batter's hand and the bat to enhance the batter's ability to maintain a firm grip on the bat. Another example is a weight-lifter's glove having a moderately padded palm surface similar to the previously described cycling glove. The weight-lifter's glove provides padding between a weight-lifter's hand and a weight bar.

Although standard gloves, such as those described above, provide protection to the wearer's hand and assist the wearer with grasping objects, the wearer's control of the grasped object is sacrificed to an extent because the objects are non-spherically shaped. For example, when grasping the handle grip of the bicycle, the padding in the cycling gloves tend to gather together to impede the cyclist's ability to grasp the handle grip. Likewise, when grasping the weight bar, the padding in the weight-lifter's gloves also tends to gather as the weight-lifter grabs the bar. The batter's glove depends on the "tackiness" of the tactile palm surface to assist the batter with holding the bat, but the maximum amount of control and handling force the hand may apply on the bat is reduced by the void that remains in the mid-palmer space of the hand. The term "mid-palmer space" is defined herein to mean the space formed in the palm of the hand between the object and the hand.

Thus, a need exists for a sports glove that enables a wearer to firmly and comfortably grasp objects having a generally cylindrical shape. Further needed is a glove that improves the wearer's ability to grasp and wield an object having a generally cylindrical shape while maximizing the amount of handling force the wearer's hand applies to the object.

SUMMARY OF THE INVENTION

The invention provides a sports glove that enables a wearer to firmly and comfortably grasp objects having a generally cylindrical shape. In particular, the invention provides a glove that improves the wearer's ability to grasp an object having a generally cylindrical shaft-like handle while maximizing the amount of handling force the wearer's hand applies to the object. The sports glove includes a glove having a palm portion and a resilient and compressible pad that is attachable to the palm portion of the glove.

The glove covers at least a portion of the wearer's hand including the palm of the hand. The glove includes a palm portion for covering the palm, a first digit receiving portion for covering at least a portion of the thumb of the hand, a second digit receiving portion for covering at least a portion of the index finger of the hand, a third digit receiving portion for covering at least a portion of the middle finger of the hand, a fourth digit receiving portion for covering at least a portion of the ring finger of the hand and a fifth digit receiving portion for covering at least a portion of the pinky finger of the hand. The palm portion of the glove includes a thenar portion for covering the thenar pad of the hand and a hypothenar portion for covering the hypothenar pad of the hand.

The compressible pad includes a generally planar glove attachment surface and a generally convex palm engaging surface opposite the glove attachment surface. The glove attachment surface of the pad is attached to the inner surface of the palm portion of the glove so that the palm engaging surface faces the palm of the hand. The pad has a generally tear drop shape that allows the pad to preferably fit into the mid-palmer space of the hand within the palmer limit of the first web space of the hand, the palmer limit of the finger pads over the second, third, and fourth metacarpal heads of hand, the palmer limit of the hypothenar pad and the palmer limit of the thenar pad.

OBJECTS OF THE INVENTION

The principal object of the present invention is to provide a sports glove that enables a wearer to firmly and comfortably grip or grasp objects having a generally cylindrical shape.

A further, more particular object of the present invention is to provide a sports glove that enables a wearer to firmly and comfortably grasp objects having generally cylindrical handles.

A further, more particular object of the present invention is to provide a sports glove that enables a wearer to firmly and comfortably grasp objects having generally cylindrical handles while maximizing the wearer's ability to control and manipulate the object.

A further, more particular object of the present invention is to provide a sports glove that improves a wearer's ability to grasp an object having a generally cylindrical handle while maximizing the amount of handling force the wearer's hand applies on the object.

A further, more particular object of the present invention is to provide a sports glove that enables a wearer to firmly and comfortably grasp objects having generally cylindrical handles while minimizing callous formation on the wearer's hands.

Another object of the present invention is to provide a compressible pad that can be applied to gloves used for gripping objects having generally cylindrical handles.

BRIEF DESCRIPTION OF THE DRAWINGS

The foregoing and other objects will become more readily apparent by referring to the following detailed description and the appended drawings in which:

FIG. 1 is a perspective view of a human hand.

FIG. 6 is a perspective view of an alternative embodiment of a compressible pad in accordance with the present invention.

DETAILED DESCRIPTION

Figure 2:
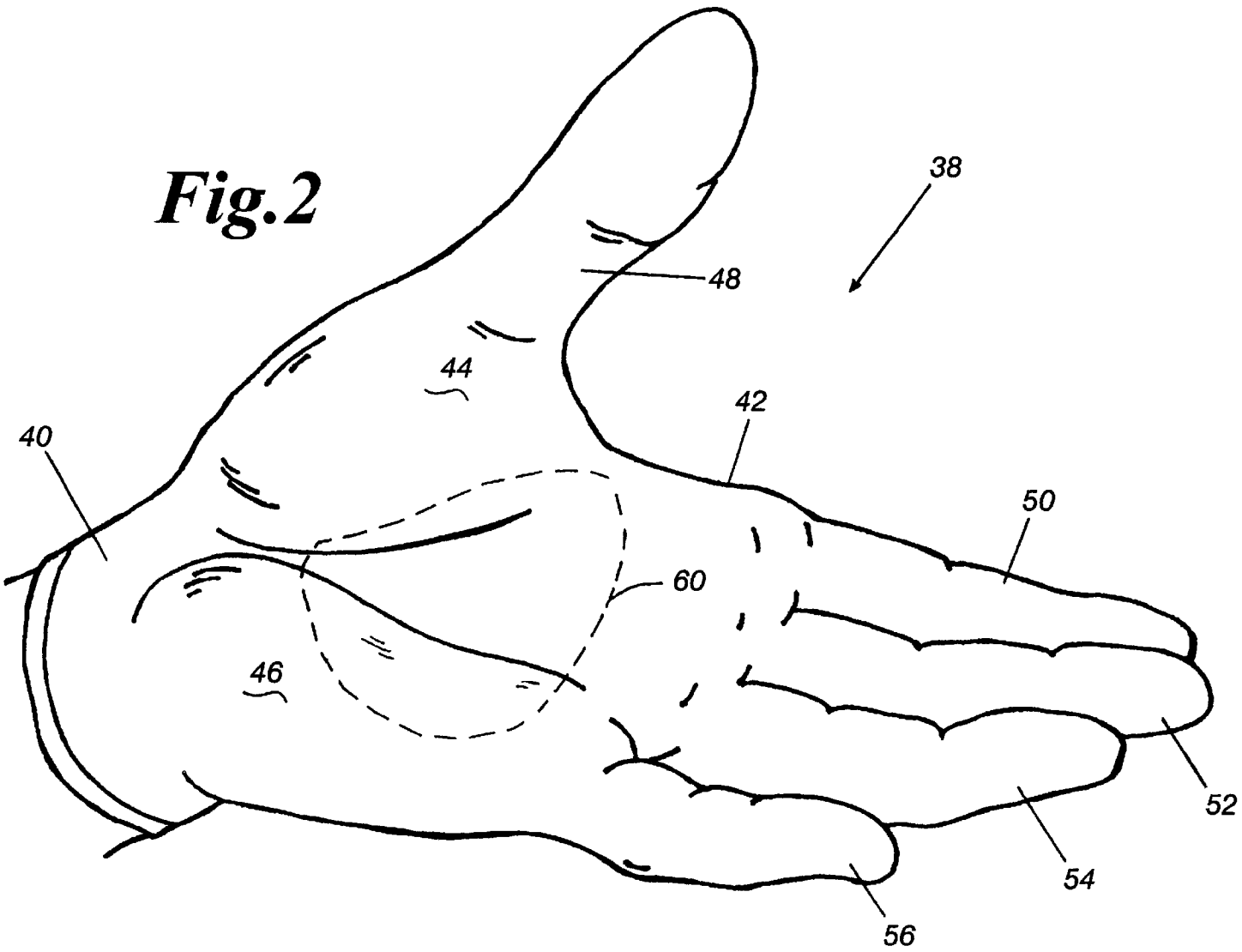
FIG. 2 is perspective view of a sports glove in accordance with the present invention.

While the present invention is described in the context of an anatomical hand, this is merely for convenience of explanation and not intended to be limiting. Referring now to the drawings, FIG. 1 is a perspective view of a typical human hand 10 having digits including a thumb 12, an index finger 14, a middle finger 16, a ring finger 18, a pinky finger 20 and a palm 30. The palm includes a thenar pad 32 and a hypothenar pad 34. Each of the fingers are connected to a corresponding metacarpal (not shown) of the hand at the head of the metacarpal to form a knuckle. The term "web space" is defined herein to mean a region located between two adjacent digits of the hand. The term "palmer limit" is defined herein to mean the perimeter of a particular portion of the hand in the direction of the center of the hand.

FIG. 2 is a perspective view of the invented sports glove 38. The sports glove includes a glove 40 and a resilient and compressible pad 60. The glove 40 covers at least a portion of a wearer's hand 10 including the palm 30 of the hand. For example, the glove may cover the entire hand including all of the fingers or the glove may cover a portion of the hand and exclude, for example, coverage of the fingertips. In a preferred embodiment, the glove 40 includes a palm portion 42 for covering the palm 30, a first digit receiving portion 48 for covering at least a portion of the thumb 12 of the hand, a second digit receiving portion 50 for covering at least a portion of the index finger 14 of the hand, a third digit receiving portion 52 for covering at least a portion of the middle finger 16 of the hand, a fourth digit receiving portion 54 for covering at least a portion of the ring finger 18 of the hand and a fifth digit receiving portion 56 for covering at least a portion of the pinky finger 20 of the hand.

The palm portion 42 of the glove 40 includes a thenar portion 44 for covering the thenar pad 32 of the hand and a hypothenar portion 46 for covering the hypothenar pad 34 of the hand. The glove 40 is preferably made of a conventional material such as natural or synthetic leather. The glove 40 may take on various appearances depending on whether the glove is to be used for work, sports, or protective apparel. The glove 40 may also be fingerless such as typically used by motorcycle and bicycle riders.

Figure 3:
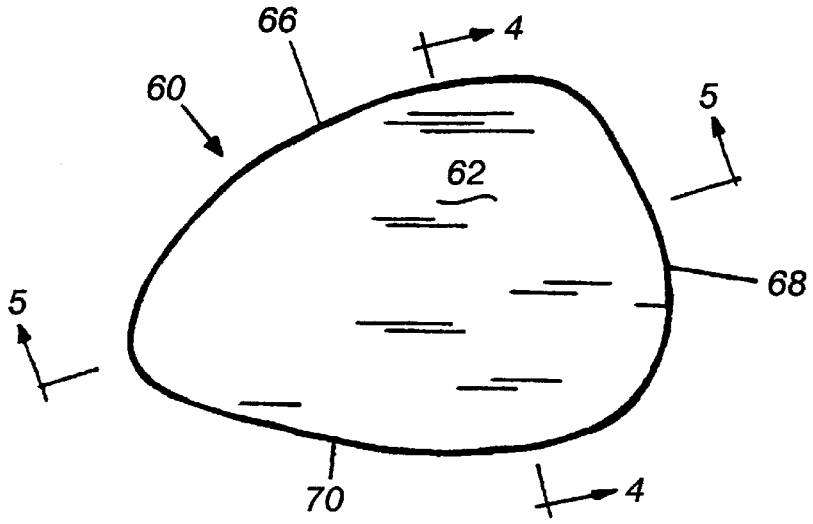
FIG. 3 is a top plan view of a preferred embodiment of a compressible pad in accordance with the present invention.
Figure 4:
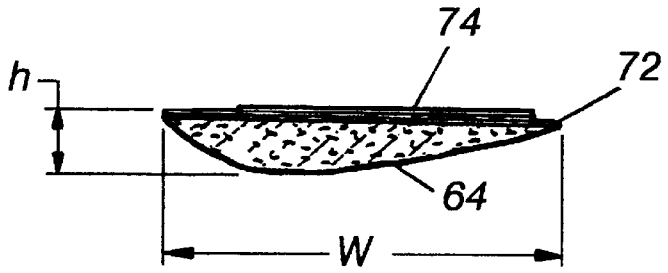
FIG. 4 is a sectional view taken along line 4—4 of FIG. 3.
Figure 5:
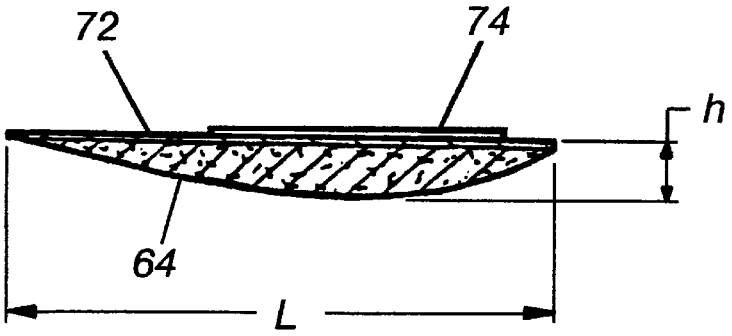
FIG. 5 is a sectional view taken along line 5—5 of FIG. 3.

FIGS. 3 through 5 show the compressible pad 60. The compressible pad 60 includes a generally planar glove attachment surface 62 (FIG. 3), a generally convex palm engaging surface 64 (FIGS. 4 and 5) opposite the glove attachment surface 62, a generally arcuate convex base edge 66, a generally arcuate convex hypothenar edge 68 coextensive with the base edge 66, and a convex thenar edge 70 coextensive with the base edge 66 and the hypothenar edge 68. The base edge 66, the hypothenar edge 68 and the thenar edge 70 form a generally tear drop shape.

The base edge 66 is proximally positioned adjacent to the second digit receiving portion 50 of the glove 40, the third digit receiving portion 52 of the glove 40 and the fourth digit receiving portion 54 of the glove 40. For example, when the sports glove 38 is worn on the hand, the base edge 66 is positioned proximate to the base of the knuckles of the hand. The hypothenar edge 68 is preferably positioned adjacent the hypothenar portion 46 of the glove 40. The thenar edge 70 is preferably positioned adjacent the thenar portion 44 of the glove 40.

The glove attachment surface 62 of the pad 60 is attachable to the inner surface of the palm portion 42 of the glove 40. The glove attachment surface 62 of the compressible pad 60 is attached to the inner surface of the palm portion 42 of the glove 40 in a conventional manner such as by sewing or use of an adhesive (e.g., glue or iron-on). When the glove attachment surface 62 of the pad 60 is attached to the palm portion 42 of the glove 40, the palm engaging surface 64 faces the palm of the hand. Alternatively, a liner 72 (FIGS. 4 and 5), made of natural leather, synthetic leather, or the like, may cover the glove attachment surface 62 of the pad 60, and the liner 72 may be attached to the glove 40 with an adhesive 74. The pad 60 is made of a resilient and compressible material such as natural wool felt or synthetic wool felt.

The pad 60 has a long dimension L (FIG. 5), corresponding to the lengthwise cross-section of the pad 60 taken along line 5—5 of FIG. 3. Similarly, the pad 60 has a short dimension W (FIG. 4) corresponding to the widthwise cross-section of the pad 60 taken along line 4—4 of FIG. 3. The long dimension L is greater in length than the short dimension W, and the long dimension L is preferably about 1 and ⅓ times the length of the short dimension W at a maximum length. The pad 60 has a variable thickness dimension H such that when the pad 60 is attached to the glove 40, the thickness H increases in the direction of the long dimension L from about the first digit receiving portion 48 of the glove 40 to about the fifth digit receiving portion 56 of the glove 40. The thickness H of the pad 60 preferably increases in the direction of the long dimension L from about the first digit receiving portion 48 of the glove 40 to about the fourth digit receiving portion 56 of the glove 40, and decreases from about the fourth digit receiving portion 56 to the hypothenar edge 68 of the pad 60, as best shown in FIG. 5. The pad 60 is biomechanically and correctly contoured to the general shape of the mid-palmer space of the hand.

As best shown in FIG. 2, when the sports glove 38 is positioned on the hand, the pad 60 fits into the mid-palmer space of the hand. The mid-palmer space extends from the center of the palm to the periphery defined by the first web space between the thumb 12 and the index finger 14, the palmer limit of the index finger pad, the middle finger pad and the ring finger pad, the palmer limit of the hypothenar pad 34 and palmer limit of the thenar pad 32.

FIG. 6 shows an alternative embodiment of a compressible and resilient pad in accordance with the present invention. As previously mentioned, the glove attachment surface 62 of the compressible pad 60 is attached to the inner surface of the palm portion 42 (FIG. 2) of the glove 40 by use of an adhesive. In the alternative embodiment, the pad 60 includes a pre-applied adhesive coating (not shown) on the glove attachment surface 62 and a removable adhesive backing film 76. The adhesive backing film 76 is removable so that the wearer may readily attach the pad 60 to the inner surface of any glove 40 using the pre-applied adhesive coating.

The resilient and compressible pad 60 improves the gripping ability of the hand when grasping various machine parts, tools, rackets, bats, clubs, weights and other cylindrical shaped handles. When gripping an object having a cylindrical shaped handle, the pad 60 redistributes pressure on the hand to reduce callous formation and brings more of the surface of the clasped hand in contact with the cylindrical shaped handle to improve control and accuracy in wielding the object. The resilient and compressible pad 60 also reduces any pressure exerted on the palm of the hand from, for example, a jack hammer or other high-vibration object having a cylindrical handle.

The pad 60 increases the area of the hand 10 that exerts pressure on an object having a generally cylindrical handle to obtain a firmer grip and reduces the pressure on the metacarpal heads of the fingers so as to inhibit callous formation. This is achieved by using the pad 60 to fill that part of the palm that does not ordinarily come in direct contact with the cylindrical handle being grasped. The sports glove 38 improves the biomechanical function of the hand when gripping an object having a generally cylindrical handle, particularly when the diameter of the handle of such object is small and difficult to grasp. Additionally, by increasing the amount of force that the third and fourth metacarpals can exert on the cylindrical handle, the gripping force and control exerted by the fingers of the hand on the cylindrical handle is further improved.

SUMMARY OF THE ACHIEVEMENT OF THE OBJECTS OF THE INVENTION

From the foregoing, it is readily apparent that the invented sports glove enables a wearer to firmly and comfortably grasp objects having generally cylindrical shape. In particular, the present invention provides a sports glove that enables a wearer to firmly and comfortably grasp objects having generally cylindrical handles while maximizing the wearer's ability to control and manipulate the object. The present invention further provides a sports glove that improves a wearer's ability to grasp an object having a generally cylindrical handle while maximizing the amount of handling force the wearer's hand applies to the object. The present invention further provides a sports glove that enables a wearer to firmly and comfortably grasp objects having generally cylindrical handles while minimizing callous formation on the wearer's hands. The present invention provides a compressible pad that can be applied to gloves used for gripping objects having generally cylindrical handles.

It is to be understood that the foregoing description and specific embodiments are merely illustrative of the best mode of the invention and the principles thereof, and that various modifications and additions may be made to the apparatus by those skilled in the art, without departing from the spirit and scope of the invention, which is therefore understood to be limited only by the scope of the appended claims.

What is claimed is:

1. A compressible pad for use in conjunction with a sports glove worn on a hand, the glove having an inner surface and an outer surface, said pad comprising:

a flat surface positionable adjacent the inner surface of the glove; and a convex surface opposite said flat surface and facing the palm of the hand when said flat surface is positioned adjacent the inner surface of the glove;

wherein said pad has a generally tear drop shape extending from the palmer limit of the first web space of the hand in the direction of the hypothenar pad of the hand when said flat surface is positioned adjacent the inner surface of the glove and the glove is worn on the hand.

2. A compressible pad according to claim 1 wherein said pad further comprises:

a generally arcuate convex base edge proximally positionable adjacent the second, third and fourth metacarpals of the hand;

a generally arcuate convex hypothenar edge coextensive with said base edge and positionable adjacent the hypothenar pad of the hand; and a convex thenar edge coextensive with said hypothenar edge and said base edge and positionable adjacent the thenar pad of the hand.

3. A compressible pad according to claim 2 wherein said compressible pad further comprises:

a long dimension corresponding to a lengthwise cross-section of said pad; and a short dimension corresponding to a widthwise cross-section of said pad.

4. A compressible pad according to claim 3 wherein said long dimension is greater than said short dimension.

5. A compressible pad according to claim 3 wherein said long dimension is about 1⅓ times the distance of said short dimension.

6. A compressible pad according to claim 3 wherein said compressible pad further comprises a thickness dimension.

7. A compressible pad according to claim 6 wherein said thickness dimension generally increases in the direction of the long dimension from about the first metacarpal of the hand to about the fifth metacarpal of the hand when said flat surface is positioned adjacent the inner surface of the glove and the glove is worn on the hand.

8. A compressible pad according to claim 6 wherein said thickness dimension generally increases in the direction of the long dimension from about the first metacarpal of the hand to about the fourth metacarpal of the hand, and decreases from about the fourth metacarpal of the hand to the hypothenar edge of the pad when said flat surface is positioned adjacent the inner surface of the glove and the glove is worn on the hand.

9. A compressible pad according to claim 1 wherein said pad is made of a material selected from the group consisting of natural wool felt or synthetic wool felt.

10. A sports glove to be worn on a hand, the sports glove comprising:

a glove for covering a hand and at least a portion of the fingers of the hand, said glove having an inner surface and an outer surface; and a compressible pad attached to said inner surface of said glove, said pad comprising:

a generally planar glove attachment surface; and a generally convex palm engaging surface opposite said glove attachment surface;

wherein said compressible pad is generally tear drop shaped.

11. A sports glove according to claim 10 wherein said compressible pad further comprises:

a generally arcuate convex base edge proximally positionable adjacent the knuckles of the second, third and fourth metacarpals of the hand;

a generally arcuate convex hypothenar edge coextensive with said base edge and positionable adjacent the hypothenar pad of the hand; and a convex thenar edge coextensive with said hypothenar edge and said base edge and positionable adjacent the thenar pad of the hand;

wherein said base edge, said hypothenar edge and said thenar edge form the generally tear drop shape of said pad.

12. A sports glove according to claim 11 wherein said compressible pad has a thickness dimension generally increasing from about the first metacarpal of the hand to about the fourth metacarpal of the hand and generally decreasing from about the fourth metacarpal of the hand to said hypothenar edge of said pad.

13. A sports glove according to claim 10 wherein said compressible pad has a thickness dimension generally increasing in the direction from about the first metacarpal of the hand to about the fifth metacarpal of the hand.

14. A sports glove to be worn on a hand, the sports glove comprising:

a glove for covering a hand and at least a portion of the fingers of the hand, said glove having a palm portion; said palm portion having an inner surface; and a resilient and compressible pad attached to said inner surface of said palm portion of said glove, said pad comprising:

a generally planar glove attachment surface; and a generally convex palm engaging surface opposite said glove attachment surface;

wherein said pad is generally tear drop shaped.

15. A sports glove according to claim 14 wherein said glove further comprises:

a first digit receiving portion;

a second digit receiving portion;

a third digit receiving portion;

a fourth digit receiving portion;

a fifth digit receiving portion, said first digit receiving portion, said second digit receiving portion, said third digit receiving portion said fourth digit receiving portion and said fifth digit receiving portion for receiving the fingers of the hand;

a thenar portion corresponding to the thenar pad of the hand; and a hypothenar portion corresponding to the hypothenar pad of the hand.

16. A sports glove according to claim 15 wherein said pad further comprises:

a generally arcuate convex base edge positioned proximal to said second digit receiving portion of said glove, said third digit receiving portion of said glove and said fourth digit receiving portion of said glove;

a generally arcuate convex hypothenar edge coextensive with said base edge and positioned adjacent said hypothenar portion of said glove; and a convex thenar edge coextensive with said hypothenar edge and said base edge and positioned adjacent the thenar portion of said glove;

wherein said base edge, said hypothenar edge and said thenar edge form the generally tear drop shape of said pad.

17. A sports glove according to claim 16 wherein said pad further comprises:

a long dimension corresponding to a lengthwise cross-section of said pad; and a short dimension corresponding to a widthwise cross-section of said pad;

wherein said long dimension is greater than said short dimension.

18. A sports glove according to claim 17 wherein said long dimension is about1⅓ times the distance of said short dimension.

19. A sports glove according to claim 17 wherein said compressible pad further comprises a thickness dimension.

20. A sports glove according to claim 19 wherein said thickness dimension generally increases in the direction of said long dimension from about said first digit receiving portion to about said fourth digit receiving portion and generally decreases from about said fourth digit receiving portion to said hypothenar edge of said pad.

* * * * *